United States Patent [19]

Samuels

[11] 4,015,167

[45] Mar. 29, 1977

[54] CIRCUITS FOR OPERATING ELECTRIC DISCHARGE LAMPS

[75] Inventor: Philip Rufus Samuels, London, England

[73] Assignee: The General Electric Company Limited, London, England

[22] Filed: June 25, 1975

[21] Appl. No.: 590,296

[30] Foreign Application Priority Data

July 2, 1974 United Kingdom ..... 29290/74

[52] U.S. Cl. ..... 315/99; 315/101; 315/105; 315/283; 315/DIG. 2; 315/DIG. 5

[51] Int. Cl.[2] ..... H05B 41/23

[58] Field of Search ..... 315/99, 101, 103, 105, 315/194, 207, 283, DIG. 2, DIG. 5

[56] References Cited

UNITED STATES PATENTS

| | | | |
|---|---|---|---|
| 3,649,869 | 3/1972 | Nomura et al. | 315/DIG. 5 |
| 3,886,405 | 5/1975 | Kubo | 315/283 X |
| 3,917,976 | 11/1975 | Nuckolls | 315/DIG. 5 |

*Primary Examiner*—Eugene R. LaRoche
*Attorney, Agent, or Firm*—Kirschstein, Kirschstein, Ottinger & Frank

[57] ABSTRACT

A circuit for operating an electric discharge lamp wherein a change in the mode of operation of the circuit is effected in response to a change of phase of a voltage or current in the circuit which occurs during operation e.g. when the lamp strikes or as the lamp runs up to full current.

9 Claims, 10 Drawing Figures

CIRCUITS FOR OPERATING ELECTRIC DISCHARGE LAMPS

This invention relates to circuits for operating electric discharge lamps.

To achieve reliable operation a circuit for operating an electric discharge lamp is often required to operate in different modes during starting and subsequent running of the lamp. For example, in the case of fluorescent lamps the operating circuit may be required to supply current to electrode heaters in the lamp during starting until the lamp strikes, whereafter the supply of heater current is cut off. In the case of low pressure sodium lamps, a higher than normal voltage may be required to be supplied to the lamp by the operating circuit during starting and subsequent run-up of the lamp to full current, the value of the voltage applied to the lamp being reduced to the normal value after run-up.

In known circuits for operating electric discharge lamps changes in the mode of operation are effected in response to changes in the amplitude of some parameter of the arrangement, such as the voltage across the lamp.

It is an object of the present invention to provide a circuit for operating an electric discharge lamp wherein a novel method of obtaining a desired change in the mode of operation of the circuit is used.

According to the present invention there is provided a circuit for operating an electric discharge lamp wherein a change in the mode of operation of the circuit is effected in response to a change in the phase of a voltage or current in the circuit during operation.

Normally said change in the phase will be a change occurring during starting of the lamp or running up of the lamp to full current.

One particular circuit in accordance with the invention, for operating a fluorescent lamp of the kind including a heater which is required to be energised during starting only, comprises: a pair of input terminals for connection to an alternating current supply; a pair of output terminals for connection across said heater; a reactive ballast impedance connected between one of said input terminals and one of said output terminals; a controllable electronic switching device connected with said terminals so as to be in series with said ballast inductance in a path for the supply of current from a source connected to the input terminals to a said heater connected across said output terminals; and a gating circuit for said switching device responsive to the potentials on both sides of said ballast impedance.

In one particular embodiment for use with a lamp having two said heaters, the operating circuit has two pairs of output terminals for connection across said heaters respectively, the ballast impedance is connected between one of the input terminals and one of a first pair of the output terminals, the switching device is connected between the other of said first pair of output terminals and one of the second pair of output terminals, and the other of said second pair of output terminals is connected to said other input terminal.

A second particular circuit in accordance with the invention for operating a low pressure sodium discharge lamp, or lamp exhibiting similar characteristics, comprises: a pair of input terminals for connection to an alternating current supply; a pair of output terminals for respective connection to different electrodes of the lamp; a reactive ballast impedance connected between one of the input terminals and one of the output terminals; a connection between the other input terminal and the other output terminal; an electronic switching device connected between a tapping point on the ballast impedance and said other input terminal, or said other output terminal or a point there-between; and a gating circuit for said switching device responsive to the voltage at said first input terminal.

In one particular embodiment the switching device is a semiconductor device and is connected to said tapping point via a capacitance and a resistance in series.

Several arrangements in accordance with the invention will now be described, by way of example, with reference to the accompanying drawings in which:

FIG. 1 is a diagram of a circuit for operating a fluorescent lamp;

FIGS. 2*a*, 2*b* and 2*c* show waveforms appearing in the circuit of FIG. 1 in operation;

FIG. 3 is a diagram of a circuit for operating a low pressure sodium lamp;

FIGS. 4*a*, 4*b* and 4*c* are waveforms appearing in the circuit of FIG. 3;

Figure 1:
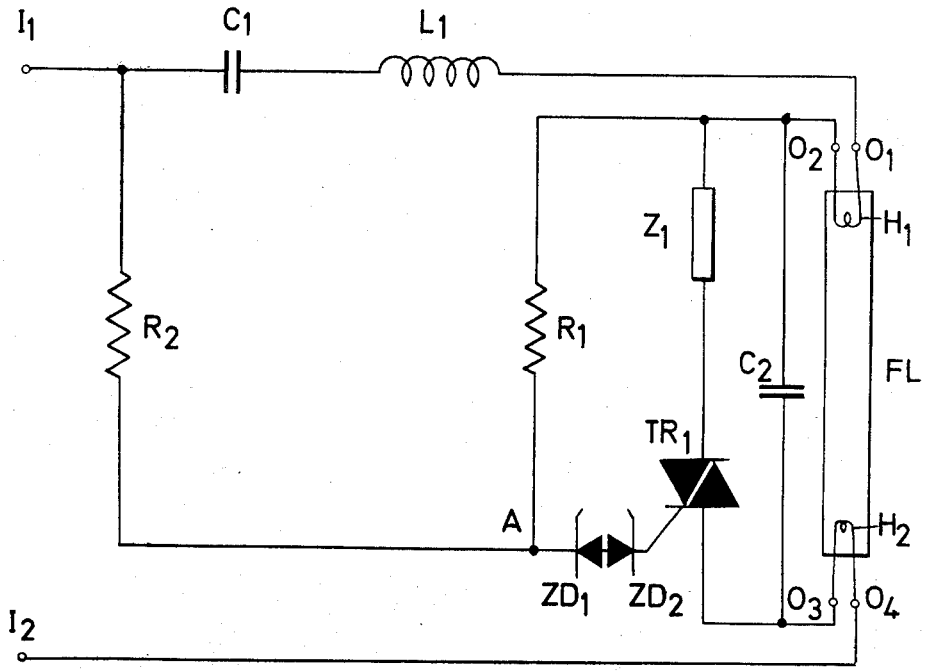

Referring to FIG. 1, the first circuit to be described includes a pair of input terminals $I_1$ and $I_2$, between which an alternating current supply is connected in operation, and two pairs of output terminals $O_1$, $O_2$ and $O_3$, $O_4$ between which electrode heaters $H_1$ and $H_2$ of the fluorescent lamp FL are respectively connected in operation. Between the input terminal $I_1$ and the output terminal $O_1$ a ballast impedance comprising a series connected inductor $L_1$ and capacitor $C_1$ are connected, the other input terminal $I_2$ being directly connected to the output terminal $O_4$. To provide a path for supply of current from the supply to the heaters $H_1$ and $H_2$ a triac $TR_1$ is connected in series with an impedance $Z_1$ between the terminals $O_2$ and $O_3$, and a capacitor $C_2$ is also connected between the terminals $O_2$ and $O_3$.

The triac is provided with a gating circuit comprising a voltage breakdown arrangement consisting of two zener diodes $ZD_1$ and $ZD_2$ connected back-to-back between the gate electrode of the triac and a point A which is connected to terminals $O_2$ and $I_1$ via two resistors $R_1$ and $R_2$ respectively.

The operation of the circuit will now be described with the terminals $I_1$ and $I_2$ connected respectively to the live and neutral terminals of the supply, the references to potentials being with respect to the terminal $I_2$.

Figure 2A:
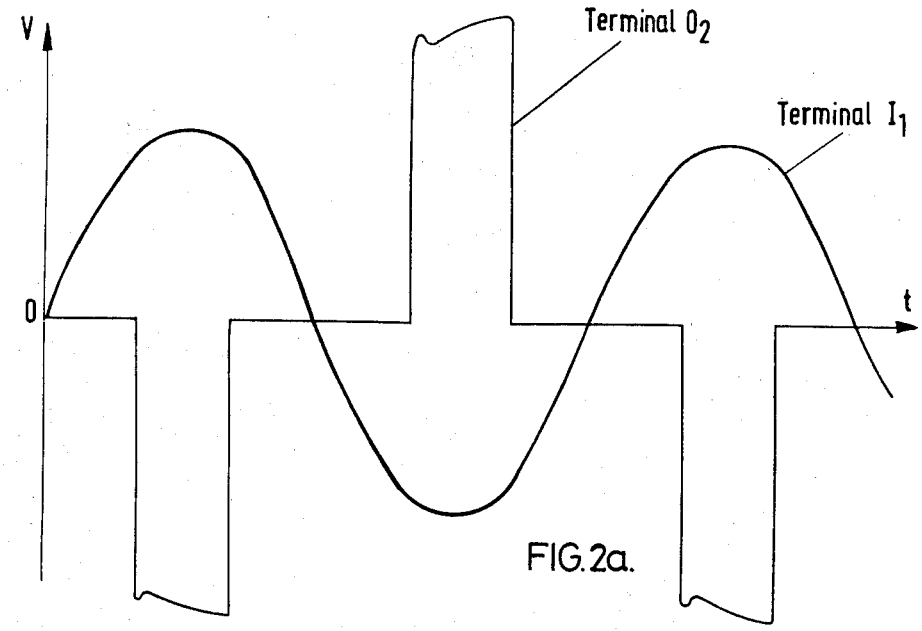

It will be appreciated that the resistors $R_1$ and $R_2$ constitute a voltage divider connected across the ballast impedance $L_1$, $C_1$ so that the potential at the point A lies between the potentials at the terminals $I_1$ and $O_2$, its exact value being dependent on the relative values of the resistors $R_1$ and $R_2$. When the supply is first connected to the terminals $I_1$ and $I_2$, the potential at the terminal $O_2$ is the same as the supply potential at the terminal $I_1$, and hence the potential at the point A also follows the supply potential at terminal $I_1$. As the potential at the terminal $I_1$, and hence point A, approaches its peak value, one or other of the zener diodes $ZD_1$ and $ZD_2$ breaks down causing the triac $TR_1$ to fire and current to flow from the supply through the heaters $H_1$ and $H_2$ via the triac $TR_1$. When the voltage across triac $TR_1$ falls to zero the triac switches off and, due to the back of emf across inductor $L_1$, the potential at the terminals $O_1$ and $O_2$ rises sharply from a value of approximately zero when $TR_1$ was conducting to a value of opposite polarity to, and larger, than the peak value of the potential at terminal $I_1$, and then continues rising relatively slowly at a rate dependent on the values of inductor $L_1$ and capacitor $C_1$ (see FIG. 2*a*).

Figure 2B:
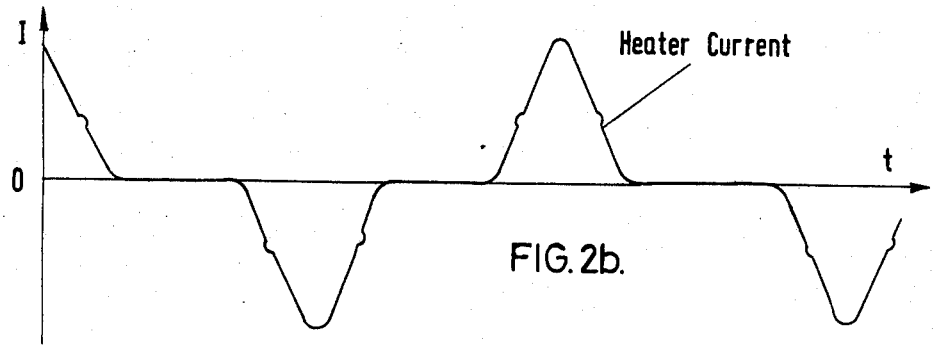

At this time the potential at point A is of the same polarity as the potential at the terminal $O_2$ and rises as the supply potential at terminal $I_1$ changes towards the potential at terminal $O_2$ until the triac $TR_1$ fires again. A further pulse of current consequently flows from the supply through the heater $H_1$ and $H_2$ via the triac $TR_1$ (see FIG. 2*b*), and when the triac again switches off the cycle is repeated.

Figure 2C:
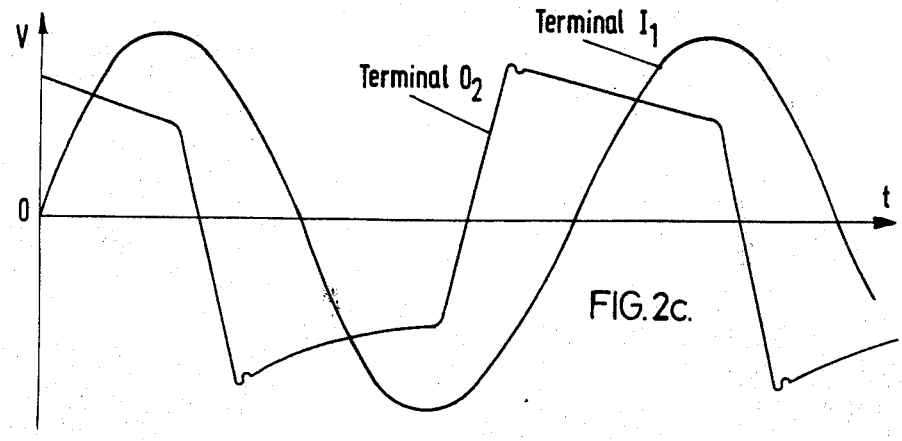

A series of pulses of heater current is thus applied to the lamp heaters, each pulse being followed by a sustained high voltage pulse across the lamp. Under these conditions the lamp rapidly strikes and the waveform of the voltage at terminals $O_1$ and $O_2$, i.e. across the lamp, assumes the form shown in FIG. 2c, the lamp voltage now approximately leading the supply voltage by 90° due to the reactance of the ballast impedance $L_1$, $C_1$. Under these conditions the potential at point A is always appreciably less than the peak value of the supply voltage at terminal $I_1$ and never reaches a sufficiently high value to fire the triac $TR_1$ so that no heater current flows in the lamp.

The impedance $Z_1$ which is normally a resistor or a small-valued inductor serves, with the capacitor $C_2$, to limit the amplitude of voltage and current peaks occurring when the conducting state of the triac $TR_1$ changes, the capacitor $C_2$ also serving to reduce any radio frequency voltages which may occur in operation.

The circuit finds particular application with lamps whose running voltage is close to the supply voltage, which lamps are most practical and economic to operate with a series capacitor/inductor ballast impedance.

In one particular embodiment of the circuit of FIG. 1 for operating an 8 foot 85 watt fluorescent lamp having a running voltage of 220 volts from a 240 volts 50 Hz supply, details of the circuit are as follows:

| | |
|---|---|
| Capacitor $C_1$ | 4.7 μfd |
| Capacitor $C_2$ | 0.02 μfd |
| Inductor $L_1$ | 0.85 Henries |
| Triac $TR_1$ | 302/500 volts |
| Diodes $ZD_1$ and $ZD_2$ | Type ZY 200 |
| Resistor $R_1$ | 85 kilohms |
| Resistor $R_2$ | 220 kilohms |

Figure 5:
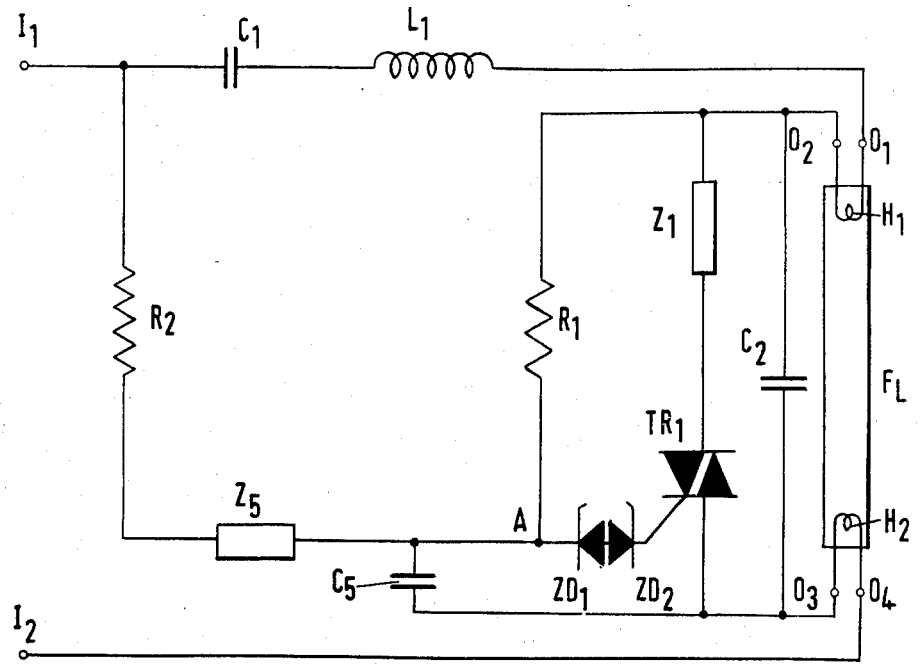
FIG. 5 shows some modifications of the circuit of FIG. 1.

In a modification of the circuit of FIG. 1, shown in FIG. 5, a capacitor $C_5$ is provided between the point A and a main electrode of the triac $TR_1$ to improve firing of the triac $TR_1$. In another modification, also shown in FIG. 5, a reactive impedance $Z_5$ is connected in series with the resistors $R_1$ and $R_2$ to obtain slight alteration of the firing angle of the triac $TR_1$.

Figure 3:
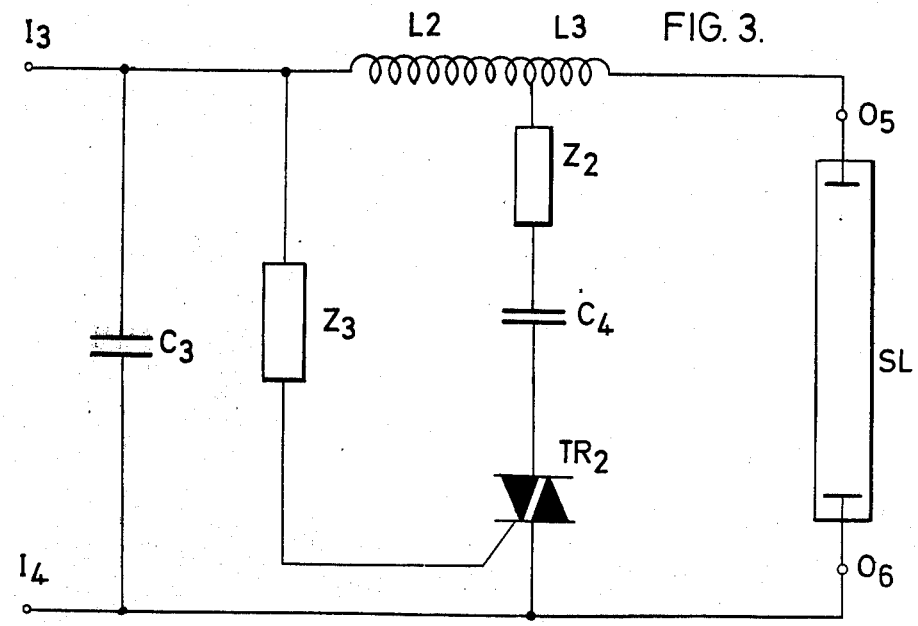

Referring now to FIG. 3, a further circuit to be described includes a pair of input terminals $I_3$ and $I_4$ between which an alternating current supply is connected in operation, and a pair of output terminals $O_5$ and $O_6$ between which a low pressure sodium lamp SL is connected in operation.

A ballast impedance comprising a tapped inductor $L_2$, $L_3$ is connected between the input terminal $I_3$ and the output terminal $O_5$, and the other input terminal $I_4$ is directly connected to the other output terminal $O_6$. A power factor capacitor $C_3$ is connected between the input terminals $I_3$ and $I_4$. A small impedance $Z_2$, a capacitor $C_4$ and a triac $TR_2$ are connected in series between the tapping point on the inductor $L_2$, $L_3$ and the input terminal $I_4$, and the gate electrode of the triac $TR_2$ is connected via a small impedance $Z_3$ to the input terminal $I_3$.

In operation of the circuit the triac $TR_2$ fires at substantially the same point in each half-cycle of the supply voltage.

Figure 4A:
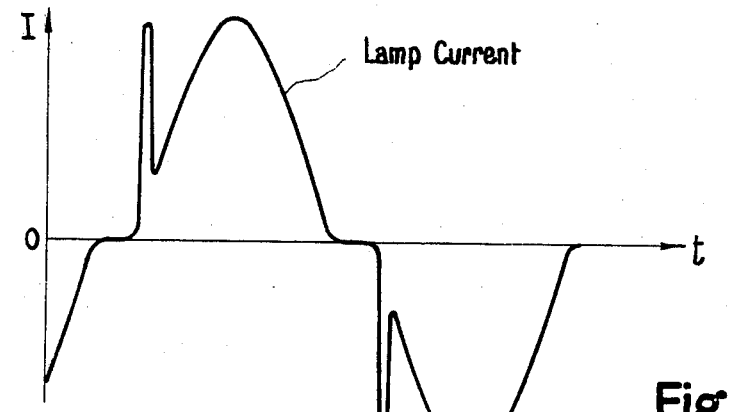

When the triac $TR_2$ fires in the first half cycle after connection of the supply, with the lamp SL cold, a high value resonant voltage is produced across the series resonant circuit comprising inductor $L_3$, capacitor $C_4$ and impedance $Z_2$, which is of sufficiently high amplitude to ignite the lamp and cause a high amplitude current pulse to pass through the lamp. After the resonant voltage has died down current continues to flow in the lamp during the rest of the half cycle in response to the supply voltage between the terminals $I_3$ and $I_4$ (see FIG. 4a).

This process is repeated during each subsequent half cycle of the supply, the magnitude of the current pulses being dependent on the values of inductors $L_2$ and $L_3$ and impedance $Z_2$, and their width being dependent also on the value of capacitor $C_4$.

Figure 4B:
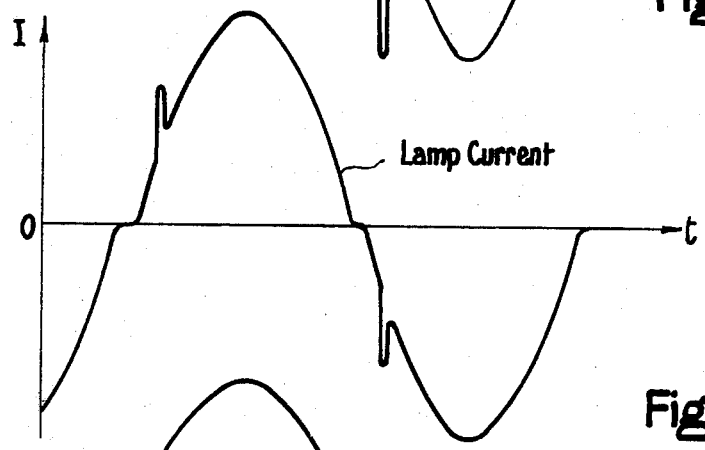

As the lamp SL warms up the lamp ignites progressively earlier during each half cycle until eventually lamp current flows before the triac $TR_2$ is fired. The passage of this lamp current through the inductors $L_2$ and $L_3$ decreases their effective inductances and therefore reduces the magnitude of the current pulses occurring when triac $TR_2$ fires (see FIG. 4*b*).

Figure 4C:
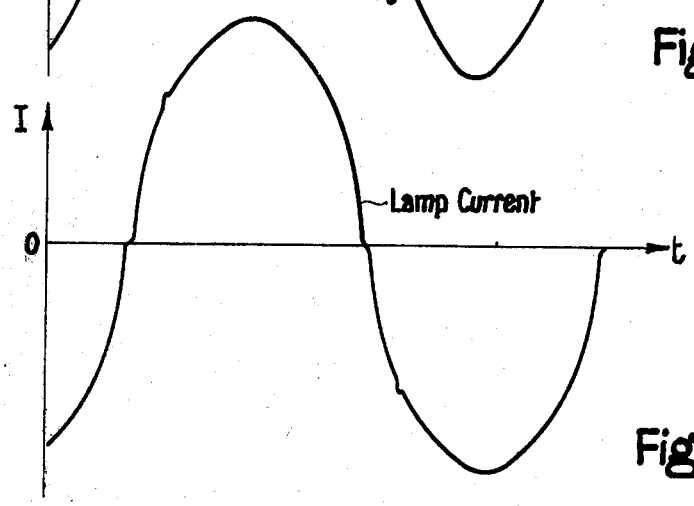

Eventually, when the lamp has run up to full current, the conduction angle of the lamp SL and the effective inductances of the inductors $L_2$ and $L_3$ are such that no appreciable current pulse occurs when the triac $TR_2$ is fired (see FIG. 4c).

Thus the starting boost provided by the triac $TR_2$ and associated components is gradually reduced in operation in response to the change of the phase of the lamp current as the lamp runs up to full current, becoming negligible at full lamp current.

The impedances $Z_2$ and $Z_3$ are typically resistances but may include a reactive element.

It will be appreciated that the circuit shown in FIG. 3 finds application with most gas discharge lamps of the kind which are conventionally operated with a step-up transformer and series inductance ballast impedance, and not just with low pressure sodium lamps.

In one particular embodiment of the circuit of FIG. 3 for operating a 55 watt sodium lamp from a 240 volt 50 Hz supply, details of the circuit are as follows:

| | |
|---|---|
| Capacitor $C_3$ | 5μfd |
| Capacitor $C_4$ | 0.22 μfd |
| Inductor $L_2$:$L_3$ | 0.9 Henries<br>$L_3$ comprising one tenth of the total winding |
| Triac $TR_2$ | 302/500 |
| Impedance $Z_2$ | 4.7 ohms |
| Impedance $Z_3$ | 30 kilohms |

Figure 6:
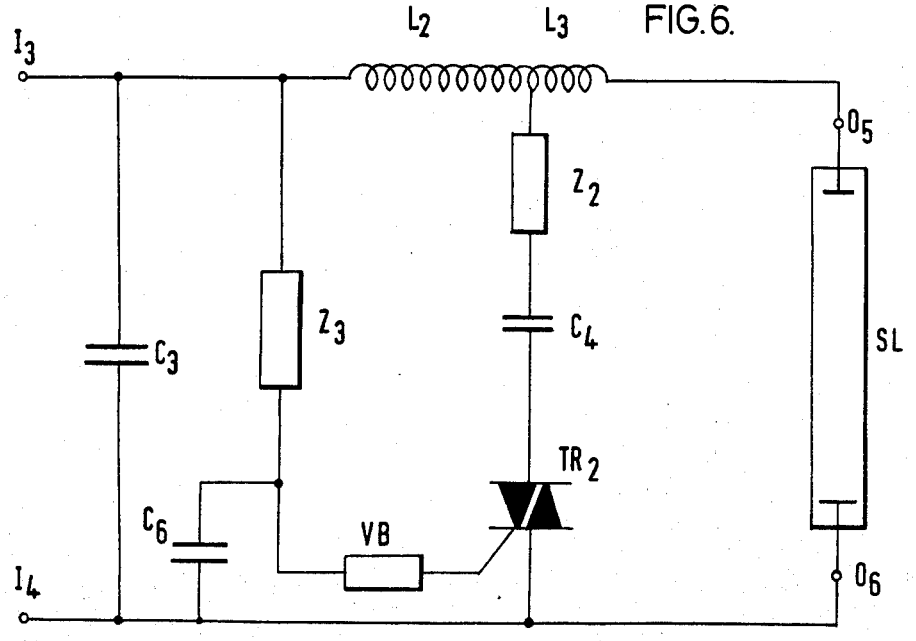
FIG. 6 shows some modifications of the circuit of FIG. 3.

In a modification of the circuit of FIG. 3 to obtain more accurate control of the firing angle of the triac $TR_2$ a voltage breakdown arrangement VB is connected between the impedance $Z_3$ and the gate electrode of the triac, as shown in FIG. 6. The voltage breakdown arrangement suitably comprises a pair of back-to-back zener diodes and/or a breakover diode. In another modification for the same purpose, also shown in FIG. 6, a capacitance $C_6$ is connected between the end of the impedance $Z_3$ nearer the triac $TR_2$ and a main electrode of the triac.

I claim:

1. A circuit for operating an electric discharge lamp comprising: a pair of input terminals for connection to an alternating current supply; a pair of output terminals for connection with the discharge lamp; and circuit means connected between said input terminals and said output terminals for controlling the supply of current to a lamp connected with the output terminals from a supply connected to said input terminals, said circuit means including means for changing the mode of operation of the circuit in response to a change in the phase of the voltage applied to the lamp relative to the phase of the voltage of the supply.

2. A circuit according to claim 1 wherein said ballast impedance comprises an inductance and a capacitance connected in series.

3. A circuit according to claim 1 for operating a low pressure sodium discharge lamp, or lamp exhibiting similar characteristics, with said output terminals respectively connected to different electrodes of the lamp, the circuit comprising: a reactive ballast impedance connected between one of the input terminals and one of the output terminals, a connection between the other input terminal and the other output terminal; and electronic switching device connected between a tapping point on the ballast impedance and said other input terminal; and a gating circuit for said switching device responsive to the voltage at said first input terminal.

4. A circuit according to claim 3 wherein said switching device is a semiconductor device and is connected to said tapping point via a capacitance and a resistance in series.

5. A circuit according to claim 3 wherein said gating circuit comprises an impedance connected between a control electrode of the switching device and said one of the input terminals.

6. A circuit according to claim 1, for operating a fluorescent lamp of the kind including a heater which is required to be energised during starting only, comprising: a reactive ballast impedance connected between one of said input terminals and one of said output terminals; a controllable electronic switching device connected with said terminals so as to be in series with said ballast inductance in a path for the supply of current from a source connected to the input terminals to a said heater connected across said output terminals; and a gating circuit for said switching device responsive to the potentials on both sides of said ballast impedance.

7. A circuit according to claim 6, for use with a lamp having two said heaters; wherein the circuit has two pairs of output terminals for connection across said heaters respectively, the ballast impedance is connected between one of the input terminals and one of a first pair of the output terminals, the switching device is connected between the other of said first pair of output terminals and one of the second pair of output terminals, and the other of said second pair of output terminals is connected to said other input terminal.

8. A circuit according to claim 6 wherein said gating circuit includes: a pair of resistances connected in series between said one of said input terminals and one of said output terminals; and a connection between the junction between said resistances and a control electrode of said switching device.

9. A circuit according to claim 8 wherein a reactive impedance is connected in series with said resistances.

* * * * *